US007426954B2

(12) United States Patent
Bohlen et al.

(10) Patent No.: US 7,426,954 B2
(45) Date of Patent: Sep. 23, 2008

(54) RATCHET-TYPE HOLDER FOR A VERTICAL BLIND VANE

(75) Inventors: Jorg Bohlen, Langen (DE); Konrad Welfonder, Bremerhaven (DE)

(73) Assignee: Hunter Douglas Industries BV, El Rotterdam (NL)

( * ) Notice: Subject to any disclaimer, the term of this patent is extended or adjusted under 35 U.S.C. 154(b) by 323 days.

(21) Appl. No.: 11/316,270

(22) Filed: Dec. 22, 2005

(65) Prior Publication Data

US 2006/0151131 A1 Jul. 13, 2006

(30) Foreign Application Priority Data

Jan. 11, 2005 (EP) ..... 05075059

(51) Int. Cl.
*E06B 9/36* (2006.01)

(52) U.S. Cl. ..... 160/177 V; 160/178.1 V

(58) Field of Classification Search ..... 160/177 V, 160/176.1 V, 168.1 V, 173 V, 172 V, 178.1 V, 160/900, 115; 403/204, 289, 298, 335, 377
See application file for complete search history.

(56) References Cited

U.S. PATENT DOCUMENTS

| | | | | |
|---|---|---|---|---|
| 3,860,056 | A * | 1/1975 | Bruneau | 160/176.1 V |
| 4,559,670 | A * | 12/1985 | Wyatt | 16/87.2 |
| 4,607,974 | A * | 8/1986 | Brothers et al. | 403/24 |
| 4,848,435 | A * | 7/1989 | Helver | 160/176.1 R |
| 4,967,823 | A * | 11/1990 | Gagnon | 160/177 R |
| 5,186,229 | A * | 2/1993 | Hsu | 160/176.1 R |
| 6,000,456 | A | 12/1999 | Neverett | |
| 6,321,821 | B1 * | 11/2001 | Wunsche | 160/178.1 V |
| 6,330,900 | B1 * | 12/2001 | Welfonder | 160/178.1 V |
| 2006/0237149 | A1 * | 10/2006 | Cech | 160/178.1 V |
| 2007/0107855 | A1 * | 5/2007 | Bohlen et al. | 160/178.1 V |

* cited by examiner

*Primary Examiner*—David Purol
(74) *Attorney, Agent, or Firm*—Dorsey & Whitney LLP

(57) ABSTRACT

A holder for interconnecting a carrier in a control system for a vertical vane covering for architectural openings with a suspended vane includes first and second parts with horizontally oriented engagement portions which are interconnectable at vertically spaced positions to move the parts between a plurality of adjusted vertical positions to adjust the spacing between the suspended vane and its associated carrier.

19 Claims, 6 Drawing Sheets

RATCHET-TYPE HOLDER FOR A VERTICAL BLIND VANE

CROSS REFERENCE TO RELATED APPLICATION

This application claims priority to European patent application No. 05075059.5, filed 11 Jan. 2005, which is hereby incorporated by reference as if fully disclosed herein.

BACKGROUND OF THE INVENTION

1. Field of the Invention

This invention relates to a holder for a vane of a vertical venetian blind assembly used, for instance, for covering an architectural opening, such as a window or door.

2. Description of the Related Art

Vertical venetian blinds have generally been provided with horizontally-extending head rails, holding a plurality of carriers or travellers that can be moved in spaced apart relationship along the longitudinal length of each head rail. Each carrier has typically supported a vertically-extending louver, slat or vane by a vane holder in such a manner that the consumer of the venetian blind could move the vane along the length of the head rail (e.g. by pulling on a first operating cord or pull cord) and also could rotate or tilt the vane about its vertical axis (e.g. by pulling on a second operating cord or tilt cord). For this purpose, each carrier has typically included a main body with a vertically oriented drive hub or worm wheel, drivingly connected to a horizontally oriented worm gear. The bottom of each drive hub has supported a depending vane holder, adapted to hold securely the top of a vane while its carrier has been moved longitudinally and while the drive hub has been rotated so as to move the vane holder and the vane and tilt them about their common vertical axis. In this regard, a longitudinally-extending tilt rod or drive shaft has been provided in the head rail, extending through the carriers and engaging their worm gears, whereby rotation of the tilt rod about its longitudinal axis has caused the drive hubs of the carriers to rotate about their vertical axes so as to make the vane holders and the attached vanes tilt together.

A problem in mounting a vertical venetian blind in a slanted or sloped architectural opening is that, for each slope angle, different vane holders are required. Specifically, a suitable length for the holder has to be chosen for each related slope under which the blind is mounted, since the length of the vane holder influences the space the vane of the blind has for rotating and thus tilting. When the holder is too short, the upper marginal portion of the vane hits the head rail when rotated. When the holder is too long, it negatively affects the look of the blind. The steeper the slope, the longer the holder has to be. Generally, a blind manufacturer will offer a limited number of different length holders, each having a specific length and use for a specific number of slopes. So each holder of a specific length will be used for a range of slope angles. This is not ideal and will lower the quality of a blind product since it will not always be possible to have holders of the specific length necessary for a desired slope. The same problem occurs with curved mountings.

U.S. Pat. No. 6,000,456 solves a similar problem, based on a difficulty that can be encountered when mounting a vertical blind assembly adjacent an architectural opening. In particular, where the vanes of the vertical blind assembly are of a particular length, it is necessary that the head rail is positioned and mounted accurately relative to the architectural opening. If the head rail is mounted too high or too low, it becomes necessary to remount it, possibly causing undesirable damage to the architectural opening surrounding. As a solution to this problem, U.S. Pat. No. 6,000,456 proposes a vane holder having an adjustable length. The holder has a vane clasp and a clasp holder, the vane clasp having a first end, to which the vane of the blind is attached, and a second end which can be attached to the clasp holder. The holder, in turn, can be attached to a carrier of a vertical blind. The second end of the clasp has ratchet grooves, each of which can cooperate with a single locking tooth in the holder, such that a resilient ratchet-type mechanism is created. The clasp can be moved resiliently between engaging consecutively one of the securing points or ratchet grooves to the locking tooth in the holder so as to vary the height of the vane.

The adjustable length vane holders of U.S. Pat. No. 6,000,456 could, in theory, be used to solve the problem of sloped vertical blinds. Unfortunately, this is not the case since such holders were designed only for correcting small inconvenient differences in length. Furthermore, the connection between the vane clasp and the clasp holder is a single point connection, which is not a very reliable connection. In order to make the connection of the single locking tooth and the ratchet grooves more secure, the profile or depth of the locking tooth would have to be substantial. However, this would prevent adjustment of the vane holder of U.S. Pat. No. 6,000,456, which is a ratchet mechanism. Moreover, this would still not provide a really secure connection because of its single point of connection.

SUMMARY OF THE INVENTION

In order to provide an adjustable length holder that can support a vane from a carrier of a vertical blind assembly and that is more reliable and provides a more secure connection between the carrier and the vane, the holder of this invention comprises:

a length adjustable mounting comprising a first end portion connectable to the carrier and a second end portion connectable to a hook member for suspending the vane and the length adjustable mounting further comprising a first part extending downwardly in relation to the first end portion and comprising a first engagement portion projecting substantially horizontally and a second part extending upwardly in relation to the second end portion and comprising a second engagement portion projecting substantially horizontally, the first and second parts being operably engaged by the first and second engagement portions in a manner to allow displacement of the parts upwardly or downwardy relative to each other, by which the second end portion can be moved into a plurality of adjusted vertical positions relative to the first end portion, characterized in that the first part comprises at least one first arm extending downwardly from the first end portion and a plurality of first engagement portions are on the at least one first arm and the second part comprises at least one second arm extending upwardly from the second end portion and a plurality of second engagement portions are on the at least one second arm and wherein, in any of the adjusted vertical positions, more than one of the plurality of the first engagement portions are opposite, and in operative engagement with, more than one of the plurality of the second engagement portions.

Advantageously, the first and second engagement portions are complementary engagement portions. It is especially advantageous that each of the first and second engagement portions comprises at least one ridge and the ridge projects horizontally of the first or second arm, on which the ridge is positioned. It is particularly advantageous that each ridge is tooth-like. It is quite particularly advantageous that each tooth-like ridge has a cross-sectional shape of a right angled triangle, with a base, a short leg and a long leg and wherein the apex of each ridge is formed by the right angle of the triangle and the base or hypotenuse of each tooth-like ridge extends horizontally of the arm, on which the ridge is positioned. It is also particularly advantageous that each tooth-like ridge is set at an angle or pitch relative to the vertical direction of the arm, wherein each ridge of the first engagement portions is set such that the short leg is downwardly oriented at an acute angle relative to vertical and wherein each ridge of the second engagement portion is at a second pitch angle that is identical but complementary to the angle of the first tooth-like ridge and thus has its short leg upwardly oriented at an acute angle relative to vertical.

Also advantageously, the first part of the length adjustable mounting comprises two downwardly extending first arms that are opposite and parallel to each other and the second part of the length adjustable mounting comprises two upwardly extending second arms that are opposite and parallel to each other, and the arms of the first and second parts have cross-sectional shapes such that the arms can be fitted together such that when the second part of the length adjustable mounting is moved up or down relative to the first part, the arms of the second part move in the same vertical direction relative to the arms of the first part. It is especially advantageous that the cross-sectional shape of each arm is a pie-point shape, and each arm comprises an outer wall and two radial walls, the radial walls projecting radially inward from the outer wall and shaping the point of pie-point shape.

Also advantageously, the adjustable mounting further includes a locking member surrounding the first and second arms of the first and second parts of the adjustable mounting and being movable between a locked position in which relative movement between the first part and the second part is prevented and an unlocked position in which relative movement between the first part and the second part is possible.

BRIEF DESCRIPTION OF THE DRAWINGS

Further aspects of the invention will be apparent from the following description and the accompanying drawings in which.

DETAILED DESCRIPTION OF THE PREFERRED EMBODIMENTS

Figure 1:
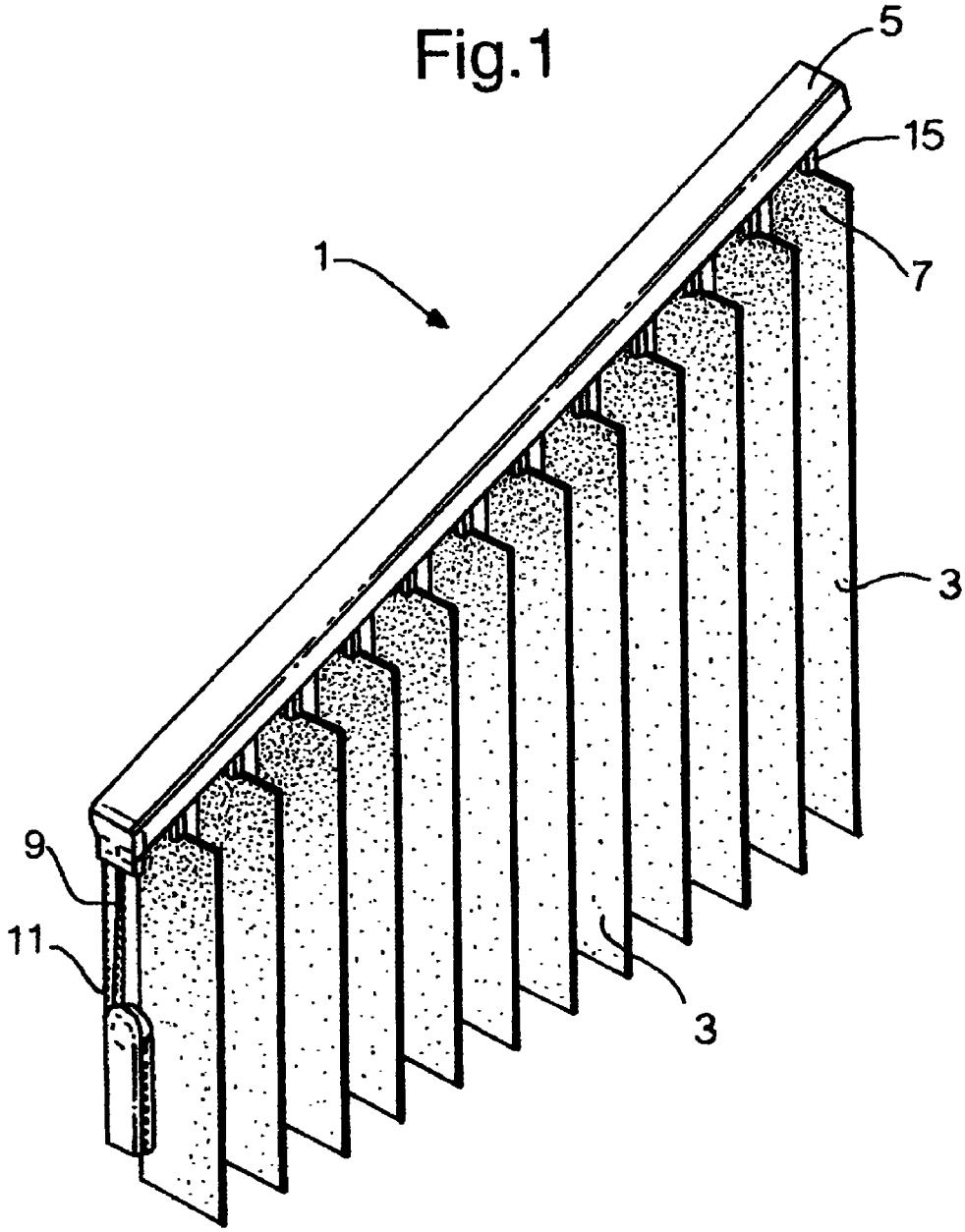
FIG. 1 is a perspective view of a vertical blind assembly including a vane holder of this invention.

FIG. 1 shows a vertical blind assembly 1 which includes a plurality of vertical vanes or louvers 3 suspended from a generally longitudinally-extending head rail 5 that is mounted at an upward slope or angle (from left to right in FIG. 1). The vanes 3 may be conventional metal, plastic or fabric slats, each having an upper marginal portion 7 securely suspended vertically from a holder 15. Each holder 15 is attached to a conventional carrier or traveller (not shown) that extends downwardly from, is carried by, and can be moved longitudinally along, the head rail 5.

As shown in FIG. 1, the head rail 5 may also be provided with a conventional pull cord 9 for moving a plurality of the carriers along the head rail and a conventional bead chain 11 which serves as a tilt cord for rotating a grooved tilt rod (not shown) of the head rail 5 so as to tilt the vanes 3.

Figure 2A:
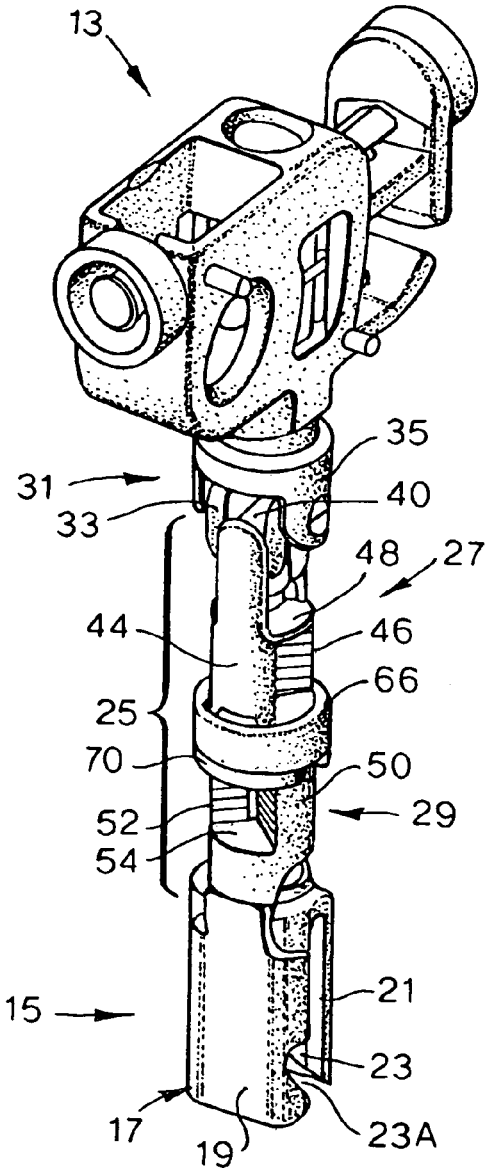
FIG. 2A is a perspective view of a first embodiment of the vane holder of the invention, attached to a carrier.
Figure 2B:
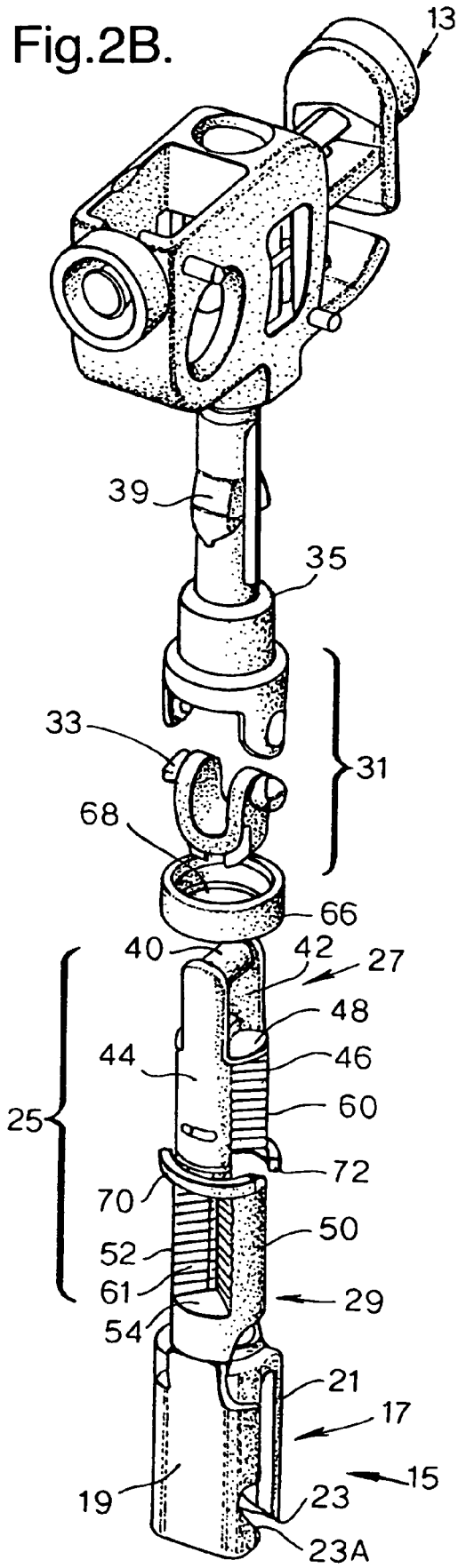
FIG. 2B is an exploded perspective view of the vane holder and carrier of FIG. 2A.
Figure 3:
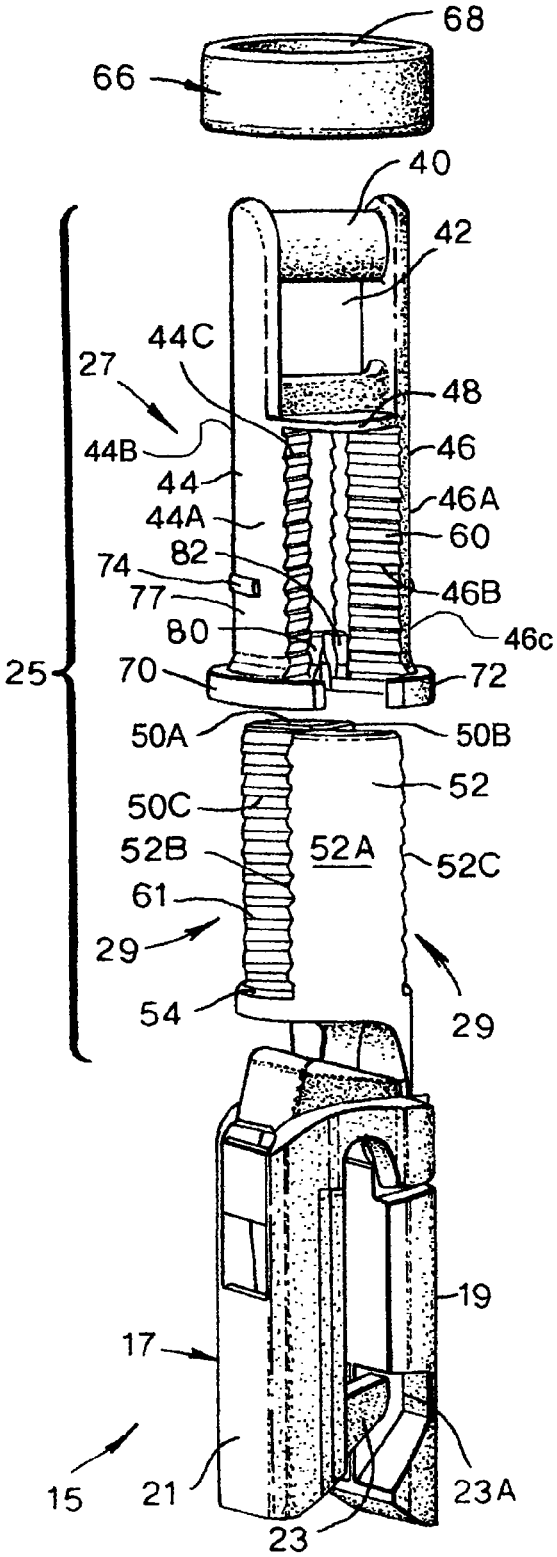
FIGS. 3 and 4 are perspective views of the adjustable portions of the vane holder of FIGS. 2A and 2B.

FIGS. 2A and 2B show the vane holder 15 with a carrier 13, which can be carried by the head rail 5. The carrier 13 and holder 15 can be can be attached to each other in any conventional manner, but a two-way mounting, such as a gimbals mounting 31 as described below is preferred for this purpose. The vane holder 15 includes a hook member 17 for carrying the vane 3. The hook member 17 has two opposing arms 19, 21 which, as shown in FIG. 3, include a hook portion 23 which mates with a recess 23A to engage with the top of the vane. Other types of hook members could be used as long as they can hold the vane.

The vane holder 15 also features a ratchet-type adjustable mounting 25 which allows the vertical length of the holder to be changed between its attachment to the carrier 13 and its hook member 17. The adjustable mounting 25 includes an upper or first part 27 that is itself attachable to the carrier 13, and a lower or second part 29 that is attached to the hook member 17. The first part 27 of the holder 15 is attached to the carrier 13 by means of a conventional gimbals mounting 31 which allows the vanes 3 to remain vertically oriented in any position. The gimbals mounting 31 includes a lower part 33 for connecting to the holder 15, and specifically to the first part 27 of its adjustable mounting 25, and an upper part 35 for connection to the carrier 13. The upper part 35 of the gimbals mounting includes a shaft with wedge-like projections 39 protruding therefrom for cooperation with the tilt gear in the carrier 13. Thereby, the gimbals mounting allows the pivoting motion of the vane holder 15 for tilting, while at the same time keeping the vanes vertical.

Figure 4:
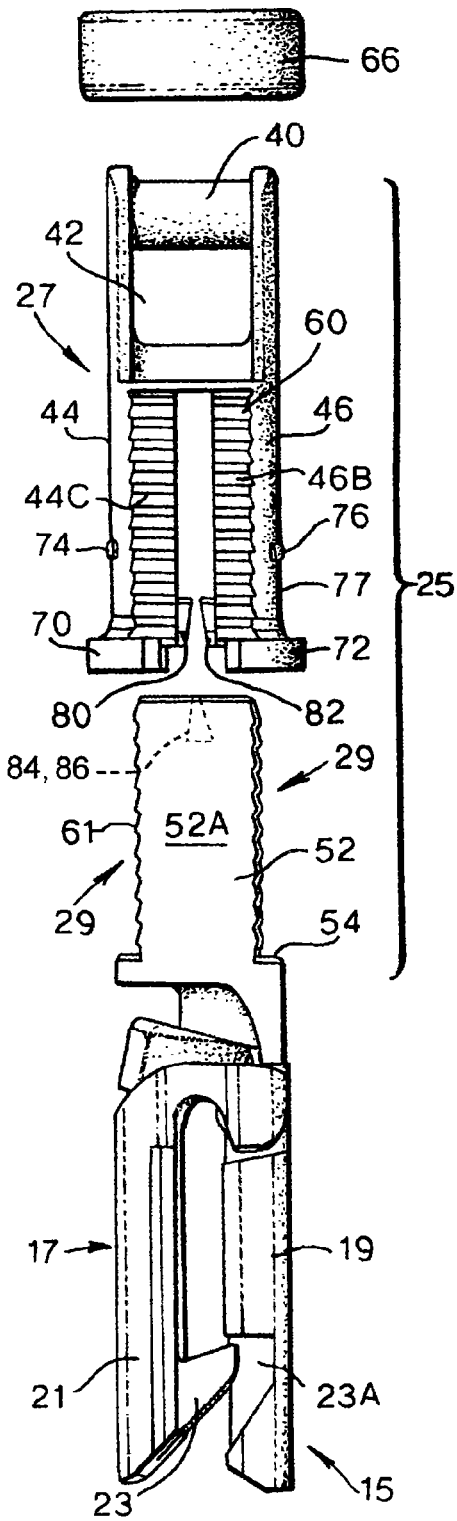

As most clearly illustrated in FIGS. 3 and 4, the second part 29 of the adjustable mounting 25 may be formed integrally with or detachably mounted to the hook member 17 respectively. However, in the illustrated embodiment, the second part 29 of the adjustable mounting 25 is integrally formed with the hook member 17.

As further illustrated in FIGS. 1-5, the first part 27 of the adjustable mounting 25 includes two parallel opposing first arms 44 and 46 extending downwardly from a first base 48. The first arms 44 and 46 also extend upwardly past the first base 48 where they are joined by a bridging member 40 to form a hollow attachment member 42 for the lower part 33 of the gimbals mounting 31. The second part 29 of the adjustable mounting 25 similarly includes two parallel opposing second arms 50 and 52, extending upwardly from a second base 54. In the assembled adjustable mounting 25, the first base 48 is upwards from the second base 54. The first and second arms 44, 46, 50 and 52 extend vertically towards each other in the assembled adjustable mounting 25 to allow adjustment of the vertical distance between the first base 48 and second base 54.

As illustrated, the first arms 44 and 46 of the first part 27 are arranged in a complementary manner with regard to the second arms 50 and 52 of the second part 29. In particular, the first part 27 and second part 29 may be fitted together such that, for a cross-section through the adjustable mounting 25, the arms 44, 46, 50 and 52 occur alternately around a vertical axis running through the adjustable mounting 25.

As illustrated, the first arms 44, 46 of the first part 27 and the second arms 50, 52 of the second part 29 have a cross-section in the shape of pie-points. Each arm has an outer wall 44A, 46A, 50A, 52A that is curved and has left and right inner walls 44B, 44C, 46B, 46C, 50B, 50C and 52B, 52C which extend horizontally and radially inwardly with respect to the vertical axis of the adjustable mounting 25. In particular, as illustrated, the left and right radial walls 44B, 44C, 46B, 46C of the first arms 44, 46 of the first part 27 oppose and engage with corresponding left and right radial walls 50B, 50C and 52B, 52C of the second arms 50 and 52 of the second part 29. The inner or radial walls of the first arms 44, 46 are provided with a substantially horizontally outwardly projecting profile which forms a plurality of first engagement portions 60. Similarly the inner or radial walls of the second arms 50 and 52 are provided with a substantially horizontally outwardly projecting profile which forms plurality of second engagement portions 61. The shape of each of the first and second engagement portions 60, 61 is best visible in FIG. 5 and are shaped as a ridges 62, 64 that are tooth-like and project substantially horizontally outwardly relative to the wall surface. The tooth-like ridges 62, 64 extend along all or at least a siginificant part of the width of the surfaces of the radial walls of the first arms 44, 46.

Adjacent each tooth-like ridge 62, 64 is a groove 63, 65. The ridges and grooves together are shaped to form a ridge-groove profile or a saw-tooth profile. The ridges 62 of the first arms of the upper part 27 are shaped to be complementary to the ridges 64 of the second arms of the lower part 29. The tooth-like ridges 62, 64 can be of any shape, but in order to facilitate easy adjustability of the first and second parts 27, 29 relative to each other, they are preferably shaped like a right triangles which are set on the first and second arms at an angle or pitch relative to the vertical axis. The right triangles of the ridges 62, 64 each have a base or hypotenuse 62A, 64A, a short leg 62B, 64B and a long leg 62C, 64C. For each triangle, the legs project from the base, and extend towards each other, at an acute angle and join each other at the right angle tooth apex 62D, 64D. The base or hypotenuse of each ridge extends vertically and is preferably integral to the respective radial wall, the right angle forming the apex of the tooth-shaped ridges and projecting substantially horizontally outwardly from the radial wall. Alternatively, the tooth apex can be rectangular or curved or rounded. The pitch angle of the first tooth-like ridges 62 on the first arms of the upper part is such that the short leg 62B is downwardly oriented at an acute angle relative to vertical. The second tooth-like ridges 64 on the second arms of the lower part are identically shaped but placed up-side down relative to the first teeth 62. So the preferred second pitch angle of the second tooth-like ridges 64 is identical but complementary to the first angle of the first part teeth and and has its short leg (64B, 164B) upwardly oriented at an acute angle relative to vertical. The preferred pitch angle is about 20-40 degrees, particularly about 30 degrees. The preferred horizontal depth of the tooth-like ridges 62, 64 is about 0.3 mm. In this manner, the adjustability of the arms in an upward direction is easier than in a downward direction. This is desirable in order to maintain a reliable and operative connection between the radial walls of the upper and the lower parts 27,29 of the adjustable mounting 25 of the vane holder 15.

Figure 5:
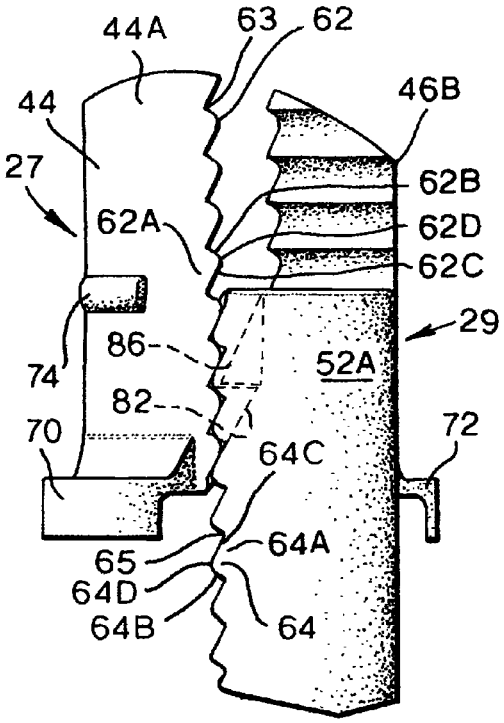
FIG. 5 is a detailed view of the complementary engagement of the adjustable portions of the vane holder of FIGS. 2A and 2B.

Each of the first part and the second parts of the adjustable mounting 25 includes a plurality of engagement portions 60, 61, 62, 63, 64, 65, and at each of the possible adjusted positions, more than one of the complementary respective first and second tooth-like ridges 62, 64 are in operative connection with one another. This is best seen in FIGS. 2A and 5, where even at the lowest possible adjusted position more than one of the tooth-like ridges are in operative connection. FIG. 5 clearly shows a plurality of the first and second tooth-like ridges in operative connection. This greatly enhances the reliability of the adjustable mounting 25.

With the holder 15, at least its arms 44 and 46 of its first part 27 are able to flex with respect to the base 48. The arms 44 and 46 may be made of a material allowing them to flex along their lengths or may be connected to the base 48 so as to allow movement relative to the base 48. In this way, the arms 44 and 46 behave similar to cantilevers with respect to the base 48. Similarly the arms 50 and 52 of the second part 29 can be made to be able to flex relative to base 54.

With the first arms 44 and 46 of the first part fitted between the second arms 50 and 52 of the second part 29, the engagement portions, the teeth-like ridges-groove formations 62-63, 64-65 formed on the radial walls 44B, 44C, 46B, 46C, 50B, 50C and 52B, 52C provide resistance to relative movement of the first part 27 and second part 29 vertically. The flexing of the first arms 44 and 46 of the first part 27 produces horizontal movement (i.e. radial movement with respect to the vertical axis of the adjustable mounting 25) of the tooth-like ridges 62, 64 formed on the radial walls, such that the first part 27 and second part 29 can move slidingly relative to one another vertically. This flexing partially or completely disengages the engagement portions of the first and second parts 27, 29. The ability to slidingly move the first and second parts 27, 29 of the adjustable mounting 25 adds ease of adjustability to the adjustable mounting.

This also means that since the first and/or second legs can flex a smaller horizontal distance outwardly nearer their base 48, 54, the ease of adjustability tends to decreases as the adjustable mounting 25 is put into its relative adjusted positions nearing its shortest length.

A first way of countering this effect is by varying the horizontal extent of the apex of the teeth-like ridges according to their position on the arm. Such that the first or second teeth that are positioned nearer their respective base 48, 54 are of a smaller horizontal extent than the first or second teeth that are nearer the free ends of their respective first or second arms. This means that the smaller horizontal flexing distance of the arms near their base is effectively neutralized.

Figure 6:
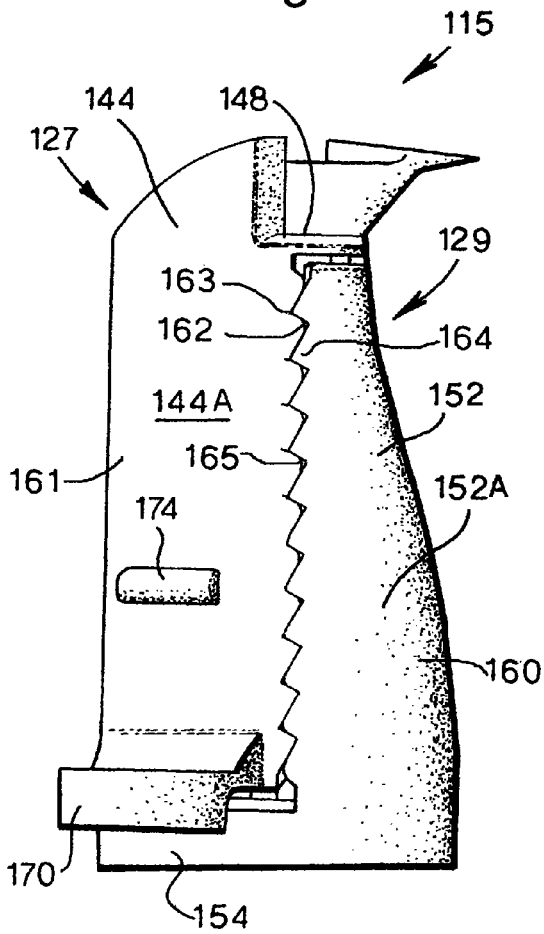
FIG. 6 is a detailed view of the complementary engagement of the adjustable portions of a vane holder of a second embodiment of the invention.

Another way of countering this effect, is by shaping the apex of the teeth progressively rounder for teeth that are closer to the base 48, 54. This is illustrated in FIG. 6. FIG. 6 thus illustrates a second embodiment of the invention, to avoid repetition of description, like features have references supplemented by 100. In FIG. 6 it is clear that the first teeth 162 on the first arm 144 of the first part, that are near the base 148 have a considerably rounder apex than the teeth near the free end of that arm. The same for the teeth 164 on the arm 150 of the second part.

Thus the combination of the shape and pitch of the teeth-like ridges and the flexibility of the arms determines the degree of the ease of vertical adjustability and the securedness of the connection between the first and second parts 27, 29 of the vane holder 15.

Where the ease of vertical adjustability and particularly sliding adjustability is deemed very important in the holder 15, this can be detrimental to the securedness of the connection of the two parts. When this is the case, the holder 15 preferably includes an additional locking member to prevent its two parts from disengaging while retaining the easy sliding adjustability.

FIGS. 2-4 show the use of such an optional locking member. To better secure the first part 27 relative to the second part 29 and, hence, better hold the adjustable mounting at a particular length, a lock can be provided in the form of a collar 66. The collar 66 defines a through-hole 68 having dimensions to match the outer surfaces of at least the first arms 44, 46 of the first part 27.

The collar 66 is able to move vertically with respect to first part 27. With the collar 66 in the vicinity of the first base 48 of the first part 27, the first arms 44, 46 are able to flex, thereby providing horizontal movement of the engagement portions and allowing relative vertical movement of the first and second parts 27, 29. However, with the collar 66 moved to a vertical end of the first part 27, distal from the base 48, the first arms 44, 46 are prevented from moving outwardly in a horizontal direction, such that the respective engagement portions of the first part 27 and second part 29 are held in engagement and relative vertical movement of the first and second parts 27, 29 is not possible.

FIG. 2A illustrates the adjustable mounting 25 in a vertically-extended state with the collar 66 at the vertically distal end of the first part 27. In this position, the adjustable mounting 25 is held securely in its extended state. Unless a user forces the arrangement to the point of damage or destruction, merely applying a vertical force to the first part and second parts 27, 29 will not result in any adjustment of the vertical length of the adjustable mounting 25.

To prevent the collar 66 from moving beyond the vertically distal end of the first part 27, at least one of the first arms 44, 46 is provided with a horizontally (i.e., radially) extending flange 70, 72 at the vertical end thereof. Preferably, each first arm is provided with such a flange. Hence, the collar is prevented from moving vertically beyond the distal end of the first part 27, since it abuts the flanges 70, 72. In some situations, there may also be concern that the collar 66 will inadvertently move the first part 27 vertically towards its base 48. For example, pre-assembled vane holders 15, prior to attachment to the head rail 5, are stored and transported as separate parts. During transport, it is possible for the collar 66 to slide out of place and subsequently for the parts to move relative to each other. To prevent this, at least one of the arms 44 and 46 of the first part 27 is provided with a horizontal protrusion 74, 76. These protrusions either provide a tighter fit between the collar 66 and the outside surfaces of the first arms 44, 46, or as shown in FIGS. 3 and 4, it can be placed at a position along the arm to create a ring zone 77 between the flanges 70, 72 and the protrusion 74, 76. The ring zone 77 preferably has a height equal to the height of the ring 66. The ring 66 can be forced over the protrusion 74, 76 due to a small amount of horizontal flexing of the arms 44, 46 and settles in the ring zone 77 at the vertically distal end of the first part 27. Hence, there is some resistance to the collar 66 moving upwardly beyond its position at the distal end of the first part 27. In this case, in the relaxed state of the arms, the protrusion 74, 76 may define, with the arms 44 and 46, an area slightly greater than that of the through hole 68 of the collar 66. The collar can then only be moved vertically beyond the protrusion 74 as a result of the resilience of the arms.

As shown in FIG. 4, each of the arms 44, 46 at the vertically distal end of the first part 27 is provided with horizontally, and radially inwardly extending, first stoppers 80, 82. Similarly, but not visible, at the vertically distal end of the second part 29, distal from its base 54, each of the second arms 50 and 52 is provided with corresponding inwardly extending second stoppers 84, 86. The first and second stoppers 80, 82, 84, 86 are placed at the meeting point of the radial walls of each arm. When seen in cross-section, the first and second stoppers 80, 82, 84, 86 extend radially inwardly from the point of the pie-point cross-section of each arm.

In the assembled state, the first stoppers 80, 82 of the arms 44, 46 of the first part 27 are positioned vertically between the second stoppers 84, 86 of the arms 50, 52 of the second part 29 and its base 54. Similarly, the second stoppers 84, 86 of the second part 29 are positioned vertically between the first stoppers 80, 82 of the first part 27 and its base 48. The first and second stoppers 80, 82 and 84, 86 extend horizontally and radially inwardly to a sufficient extent that they interact and meet each other. In this way, when the first part 27 and the second part 29 are moved to the most vertically extended state for the adjustable mounting 25, the first stoppers 80, 82 abut the second stoppers 84, 86 so as to prevent the first part 27 from separating from the second part 29.

FIG. 4 shows that the first and second stoppers 80, 82, 84, 86 are formed with a ramp profile which extends progressively further horizontally and raadially inwardly at positions closer to the respective bases 48 and 54. In this way, during assembly of the vane holder 15, it is possible to push the first and second stoppers 80, 82, 84, 86 past one another. A similar function may be achieved by providing a suitable first stopper on only one of the first arms 44, 46 and/or a second stopper on only one of the second arms 50 and 52. Indeed, where the adjustable mounting 25 is arranged such that the first arms 44, 46 flex, but the second arms 50, 52 remain rigid, it is possible for the second stoppers to be replaced by a component bridging the vertically distal ends of the parts 50 and 52.

By lifting the collar 66 and moving it upwardly to a position in the vicinity of the base 48 of the first part 27, the first arms 44, 46 are able to flex horizontally and radially outwardly such that the engagement portions 60, 61 formed on the radial walls 44B, 44C, 46B, 46C, 50B, 50C and 52B, 52C are moved horizontally and radially apart and the relative vertical position of the first and second parts 27, 29 can be adjusted. For example, the relative vertical positions of the first part 27 and second part 29 can be changed such that the adjustable mounting 25 is at its minimum vertical length. By moving the collar 66 back down to a position at the vertically distal end of the first part 27, the adjustable mounting again becomes locked. In particular, the arms 44 and 46 of the first part 27 cannot flex horizontally and radially outwardly, and the respective engagement portions 60, 61 formed on the walls 44B, 44C, 46B, 46C, 50B, 50C and 52B, 52C of the first and second parts 27, 29 remain in engagement.

FIG. 6 shows a second embodiment 115 of the adjustable length holder of the invention which is similar to the holder 15 of FIGS. 1-5 and for which corresponding reference numerals (greater by 100) are used below for describing the same parts or corresponding parts.

In the holders 15, 115 of FIGS. 1-6, the first and second engagement portions 60, 61,160,161, formed on the left and right radial walls of the first and second arms are complementary saw tooth profiles 62-63, 64-65, 162-163, 164-165. This is advantageous in providing engagement over a large surface area and, with only partial disengagement, allowing relative vertical movement of the first part 27,127 and second part 29,129. However, if slidable relative vertical movement of the parts is not desired, it is possible to use a stepped or square-wave profile. When such a profile is used, it is necessary that the arms, in a relaxed state, are in line from one another, i.e. completely disengaged.

Figure 7:
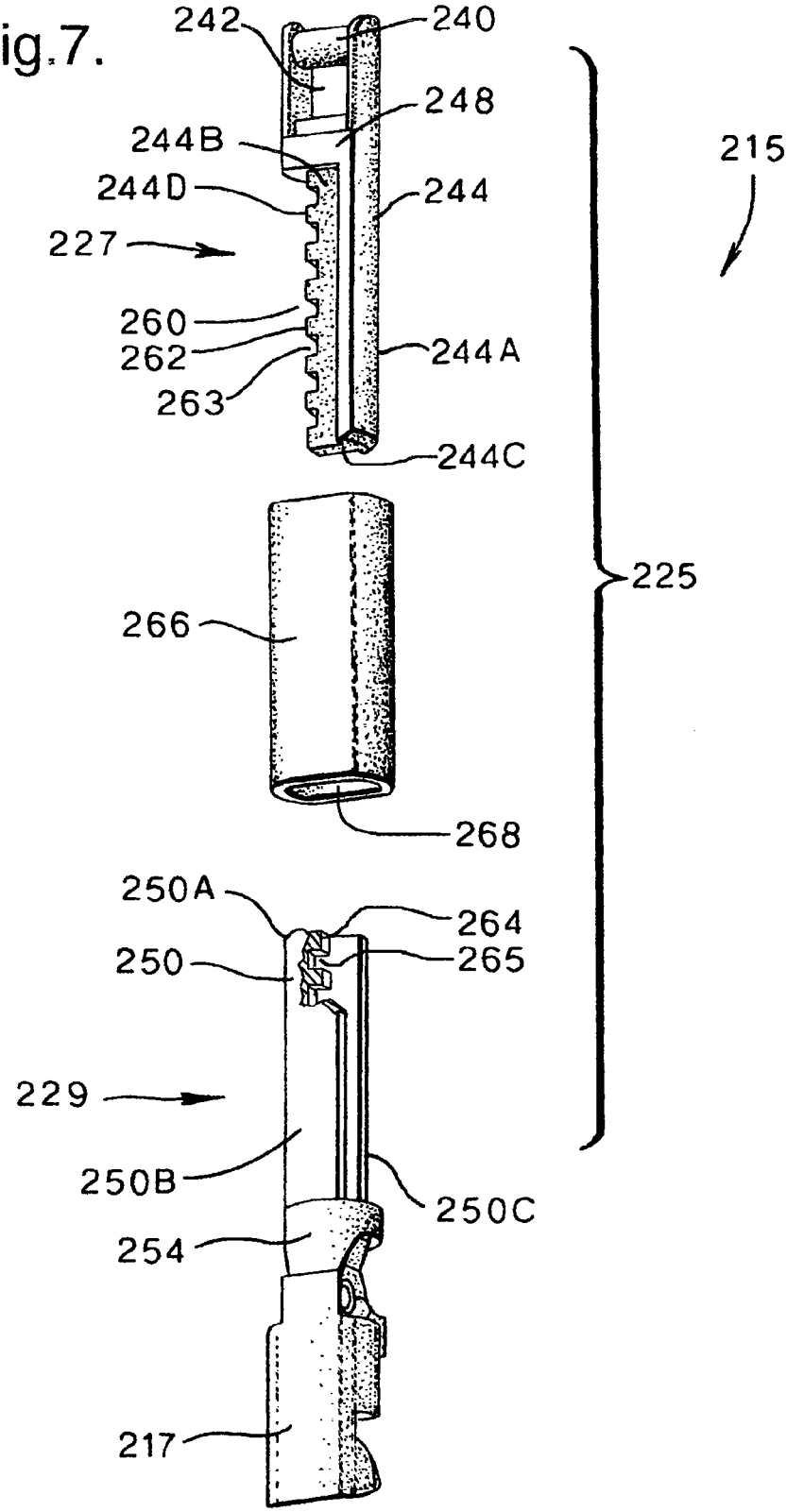
FIG. 7 is an exploded perspective view of the complementary engagement of the adjustable portions of a vane holder of a third embodiment of the invention.

FIG. 7 shows a third embodiment 215 of the adjustable length holder of the invention which is similar to the holder 15 of FIGS. 1-5 and for which corresponding reference numerals (greater by 200) are used below for describing the same parts or corresponding parts.

The adjustable mounting 225 of the holder 215 includes a first part 227, a second part 229 and a locking member 266. The first or upper part 227 is connectable to a holder (not shown) and comprises a single first arm 244 extending from a base portion 248 where it is joined by a bridging member 240 to form a hollow attachment member 242. The arm 244 includes an outer wall 244A, and an inner wall 244D and left and right walls 244B, 244C. The outer wall 244A comprises a plurality of first engagement portions 260. The second or lower part 229 is connected or connectable to a vane hook member 217 at the lower end. It further comprises a base portion 254 and an arm 250 extending vertically away from the base 254. The arm 250 is a U-shaped profile having a base wall 250A, and left and right wall 250B, 250C extending from the base. The inner surface of base 250A is provided with a plurality of engagement portions (not shown).

The engagement portions on the inner walls 244D and 250A of the arms 244 and 250 of the two parts 227,229 of the adjustable mounting are complementary ridge-groove profiles 262-263, 264-265. The ridges 262, 264 are rectangular horizontally extending ridges. Adjacent each ridge 262,264 is a groove 263,265. The grooves are of complementary shape to the ridges, so in this embodiment, the grooves also have a rectangular cross-sectional shape. When the inner walls 244D and 250A are brought into contact the complementary ridges-groove profiles provide an operative engagement between the two parts.

By surrounding the so-engaged arms 244, 250 by the locking member 266, the connection is secure. The locking member 266 is preferably a hollow sleeve like ring member. The hollow interior 268 having a cross-section that is designed to match the outer surfaces of the arms 244, 250 in engagement with each other.

In order to adjust the adjustable mounting 225 to change the vertical length of the holder 215, the sleeve 266 is removed from the first and second parts 227, 229. This allows horizontal displacement of the arms 244, 250 relative to each other. The new length is then chosen, the arms are brought into engagement by moving the arms horizontally together, and the sleeve is slid over the connected arms. The connection is very secure, and the adjustability can be more accurate than with the slidable embodiment.

In this third embodiment alternatively the engagement portions 260 can be shaped to form a snap-fit connection between the two parts. Or the ridges 262 on the first arm can be made slightly wider than the complementary grooves 265 on the second arm, to enhance the friction between the two assembled parts. In such variations the locking member is not required.

It will be appreciated that many variations are possible in the embodiments of the holder of the invention. FIGS. 8A-8E illustrates some of these variations in horizontal or vertical cross-sectional views through the adjustable mounting.

Figure 8A:
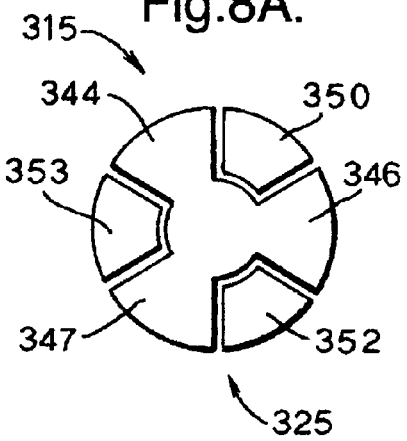
FIG. 8A is an illustration of the configuration of the complementary engagement of the adjustable portions of a vane holder of a fourth embodiment of the invention.

FIG. 8A shows a fourth embodiment 315 where the adjustable mounting 325 comprises six arms in total. In the illustrated embodiment there are three first arms 344, 346, 347 and three second arms 350, 352, 353 in complementary arrangement.

Figure 8B:
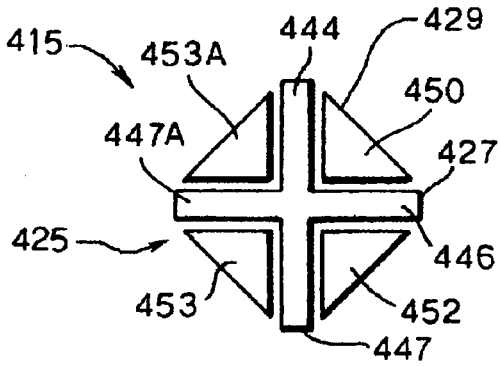
FIG. 8B is an illustration of the configuration of the complementary engagement of the adjustable portions of a vane holder of a fifth embodiment of the invention.

FIG. 8B shows a fifth embodiment 415 where the adjustable mounting 425 comprises a four first arms or arm-like flanges 444, 446, 447, 447A projecting radially outward from the first part 427. Four triangularly shaped arms 450, 452, 453 and 453A of the second part 429 are in complementary arrangement with the arm-like flanges 444, 446, 447, 447A of the first part.

Figure 8C:
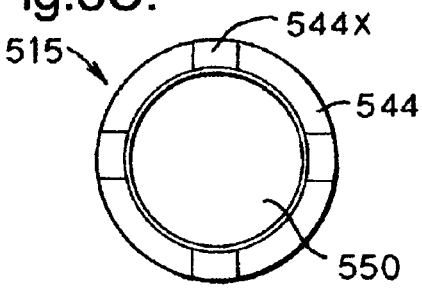
FIG. 8C is an illustration of the configuration of the complementary engagement of the adjustable portions of a vane holder of a sixth embodiment of the invention.

In FIG. 8C, the first arm 544 of a sixth embodiment 515 is shaped as sleeve like arm-profile and the second arm 550 is inserted therein. In order to provide flexibility to the arms for slidable adjustment the first arm can be provided with vertically extending slits 544X, and/or the second arm can be a-two part arm.

Figure 8D:
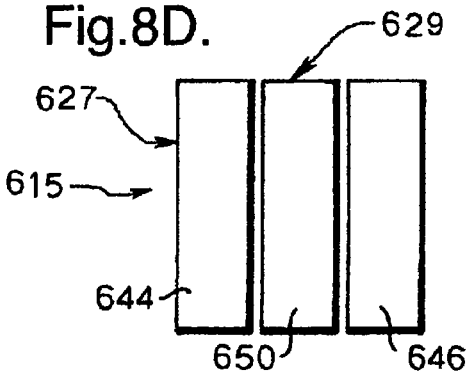
FIG. 8D is an illustration of the configuration of the complementary engagement of the adjustable portions of a vane holder of a seventh embodiment of the invention.

In FIG. 8D, the first part 627 of a seventh embodiment 615 comprises two opposite spaced apart first arms 644, 646, the second part 629 comprises a single arm 650 that is located between the two first arms.

Figure 8E:
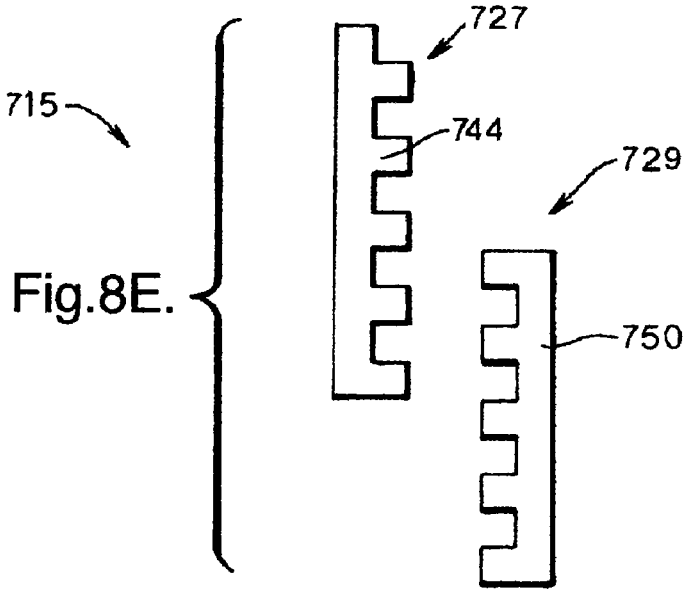
FIG. 8E is an illustration of the configuration of the complementary engagement of the adjustable portions of a vane holder of an eighth embodiment of the invention.

FIG. 8E shows a vertical cross-section of the first and second parts 727, 729 of an eighth embodiment 715. First arm 744 is provided with a square ridge-type profile and the second arm 750 is provided with a complementary type profile.

This invention is, of course, not limited to the above-described embodiments which may be modified without departing from the scope of the invention or sacrificing all of its advantages. In this regard, the terms in the foregoing description and the following claims, such as "vertical", "horizontal", "upward", "downward", "upper", "lower", "inward", "outward", "longitudinal" and "lateral", have been used only as relative terms to describe the relationships of the various elements of ratchet-type adjustable length vane holder of the invention. For example, when the vane holder is being assembled or when it is sold as a separate part of a vertical venetian blind, it can be in a generally horizontal position, and the holder in such a position would be within the scope of this invention. Also, the collar or locking member 66, 266 need not be a closed ring like or sleeve member but could be a C-shaped member that can be clipped about the first arms 44, 46, 244, 246. The collar could also be a two-part member or a member including a hinge that can be closed about the adjustable mounting 25, 225.

We claim:

1. An adjustable length holder that can support a vane from a carrier of a vertical venetian blind assembly, the vane holder having a length adjustable mounting with a first end portion connectable to the carrier and a second end portion connectable to a hook member for suspending the vane and comprising:

a first part extending downwardly in relation to the first end portion and having a first engagement portion projecting substantially horizontally, and a second part extending upwardly in relation to the second end portion and having a second engagement portion projecting substantially horizontally, the first and second parts being operably engaged by the first and second engagement portions in a manner to allow displacement of the parts upwardly or downwardly relative to each other, by which the second end portion can be moved into a plurality of adjusted vertical positions relative to the first end portion, characterized in that the first part comprises at least one first arm extending downwardly from the first end portion and a plurality of first engagement portions are on the at least one first arm and wherein the second part comprises at least one second arm extending in upwardly from the second end portion and a plurality of second engagement portions are on are the at least one second arm and wherein, in any adjusted vertical positions, more than one of the plurality of the first engagement portions are opposite, and in operative engagement with, more than one of the plurality of the second engagement portions, wherein the first part of the length adjustable mounting comprises two downwardly-extending first arms that are opposite and parallel to each other and the second part of the length adjustable mounting comprises two upwardly extending second arms that are opposite and parallel to each other and the arms of the first and second parts have cross-sectional shapes such that the arms can be fitted together such that when the second part of the length adjustable mounting is moved up or down relative to the first part, the arms of the second part move in the same vertical direction relative to the arms of the first part.

2. The vane holder of claim 1, wherein the first and second engagement portions are complementary engagement portions.

3. The vane holder of claim 2, wherein each of the first and second engagement portions comprises at least one ridge wherein the ridge projects horizontally of first or second arm on which the ridge is positioned.

4. The vane holder of claim 3, wherein each ridge is tooth-like.

5. The vane holder of claim 4, wherein each tooth-like ridge has a cross-sectional shape of a right angled triangle, with a base, a short leg and a long leg and wherein the apex of each tooth-like ridge is formed by the right angle of the triangle and the base or hypotenuse of each tooth-like ridge extends horizontally of the arm, on which the tooth-like ridge is positioned.

6. The vane holder of claim 5, wherein each tooth-like ridge is set at an angle or pitch relative to the vertical direction of the arm, wherein each tooth-like ridge of the first engagement portion is set such that the short leg is downwardly oriented at a first acute angle relative to vertical and wherein each tooth-like ridge of the second engagement portion is at a second angle that is identical but complementary to the first angle and has its short leg upwardly oriented at an acute angle relative to vertical.

7. The vane holder of claim 6, wherein the pitch angle of the tooth-like ridges on the first part and second part is within the range of 20-40 degrees.

8. The vane holder of claim 7, wherein the pitch angle is 30 degrees.

9. An adjustable length holder that can support a vane from a carrier of a vertical venetian blind assembly, the vane holder having a length adjustable mounting with a first end portion connectable to the carrier and a second end portion connectable to a hook member for suspending the vane and comprising:

a first part extending downwardly in relation to the first end portion and having a first engagement portion projecting substantially horizontally, and a second part extending upwardly in relation to the second end portion and having a second engagement portion projecting substantially horizontally, the first and second parts being operably engaged by the first and second engagement portions in a manner to allow displacement of the parts upwardly or downwardly relative to each other, by which the second end portion can be moved into a plurality of adjusted vertical positions relative to the first end portion, characterized in that the first part comprises at least one first arm extending downwardly from the first end portion and a plurality of first engagement portions are on the at least one first arm and wherein the second part comprises at least one second arm extending in upwardly from the second end portion and a plurality of second engagement portions are on are the at least one second arm and wherein, in any adjusted vertical positions, more than one of the plurality of the first engagement portions are opposite, and in operative engagement with, more than one of the plurality of the second engagement portions, wherein the first part of the length adjustable mounting comprises two downwardly-extending first arms that are opposite and parallel to each other and the second part of the length-adjustable mounting comprises two upwardly extending second arms that are opposite and parallel to each other, and the arms of the first and second parts have cross-sectional shapes such that the arms can be fitted together such that when the second part of the length adjustable mounting is moved up or down relative to the first part, the arms of the second part move in the same vertical direction relative to the arms of the first part.

10. The vane holder of claim 9, wherein the cross-sectional shape of each arm is a pie-point shape, and each arm comprising an outer wall and two radial walls, the radial walls projecting horizontally and radially inward from the outer wall and shaping the point of pie-point shape.

11. The vane holder of claim 10, wherein the first engagement portions project substantially horizontally from the radial walls of each of the arms of the first part of the length adjustable mounting, and the second engagement portions project substantially horizontally from the radial walls of each of the arms of the second part of the length adjustable mounting.

12. The vane holder of claim 11, wherein the adjustable mounting further includes a locking member horizontally surrounding the first and second arms of the first and second parts of the adjustable mounting and being movable vertically between a locked position in which relative movement between the first part and the second part is prevented and an unlocked position in which relative movement between the first part and the second part is possible.

13. The vane holder of claim 12, wherein the first and second engagement portions are complementary engagement portions.

14. The vane holder of claim 13, wherein each of the first and second engagement portions comprises at least one ridge wherein the ridge projects horizontally of first or second arm on which the ridge is positioned.

15. The vane holder of claim 14, wherein each ridge is tooth-like.

16. The vane holder of claim 15, wherein each tooth-like ridge has a cross-sectional shape of a right angled triangle, with a base, a short leg and a long leg and wherein the apex of each tooth-like ridge is formed by the right angle of the triangle and the base or hypotenuse of each tooth-like ridge extends horizontally of the arm, on which the tooth-like ridge is positioned.

17. The vane holder of claim 16, wherein each tooth-like ridge is set at an angle or pitch relative to the vertical direction of the arm, wherein each tooth-like ridge of the first engagement portion is set such that the short leg is downwardly oriented at a first acute angle relative to vertical and wherein each tooth-like ridge of the second engagement portion is at a second angle that is identical but complementary to the first angle and has its short leg upwardly oriented at an acute angle relative to vertical.

18. The vane holder of claim 17, wherein the pitch angle of the tooth-like ridges on the first part and second part is within the range of 20-40 degrees.

19. The vane holder of claim 18, wherein the pitch angle is 30 degrees.

* * * * *